United States Patent [19]

Haworth et al.

[11] 4,198,913

[45] Apr. 22, 1980

[54] COMPONENT LOCKING DEVICE

[75] Inventors: Richard G. Haworth, Holland; Ronald D. Ten Elshof, Grandville, both of Mich.

[73] Assignee: Haworth Mfg., Inc., Holland, Mich.

[21] Appl. No.: 909,968

[22] Filed: May 26, 1978

[51] Int. Cl.[2] ..... A47B 9/00; F16M 13/02

[52] U.S. Cl. ..... 108/108; 108/142; 248/221.3; 248/243

[58] Field of Search ..... 108/108, 152, 146; 248/250, 243, 221.3, 223.1; 211/192

[56] References Cited

U.S. PATENT DOCUMENTS

| | | | |
|---|---|---|---|
| 2,713,985 | 7/1955 | Kleckner et al. | 248/243 |
| 2,971,657 | 2/1961 | Zadek | 108/108 X |
| 3,085,693 | 4/1963 | Shell | 248/243 X |
| 3,207,100 | 9/1965 | Peacock | 108/152 |
| 3,273,847 | 9/1966 | Berman | 248/243 |
| 3,278,145 | 10/1966 | Leshuk | 248/221.3 X |
| 3,299,839 | 1/1967 | Nordbak | 248/243 X |
| 3,601,432 | 8/1971 | Fenwick | 211/192 X |
| 3,637,086 | 1/1972 | Klein | 211/192 |
| 3,730,108 | 5/1973 | Stroh | 211/192 X |

FOREIGN PATENT DOCUMENTS

| | | | |
|---|---|---|---|
| 670899 | 9/1963 | Canada | 211/192 |
| 1226326 | 3/1971 | United Kingdom | 211/192 |

*Primary Examiner*—James T. McCall

*Attorney, Agent, or Firm*—Blanchard, Flynn, Thiel, Boutell & Tanis

[57] ABSTRACT

An attachment structure for mounting a furniture component, such as a work surface member, on the slotted uprights of a wall panel. The attachment structure is releasably engageable with both the slotted upright and the work surface member, such as a desk top. A hook-carrying support is releasably attached to the upright, and the support in turn has the work surface member releasably attached thereto. A latching device, as mounted on the support, automatically engages the slotted upright to fixedly lock the support thereto only when the work surface member is mounted on and properly engaged with the support. The latching device also causes the front edge of the work surface member to be locked down against the support.

12 Claims, 8 Drawing Figures

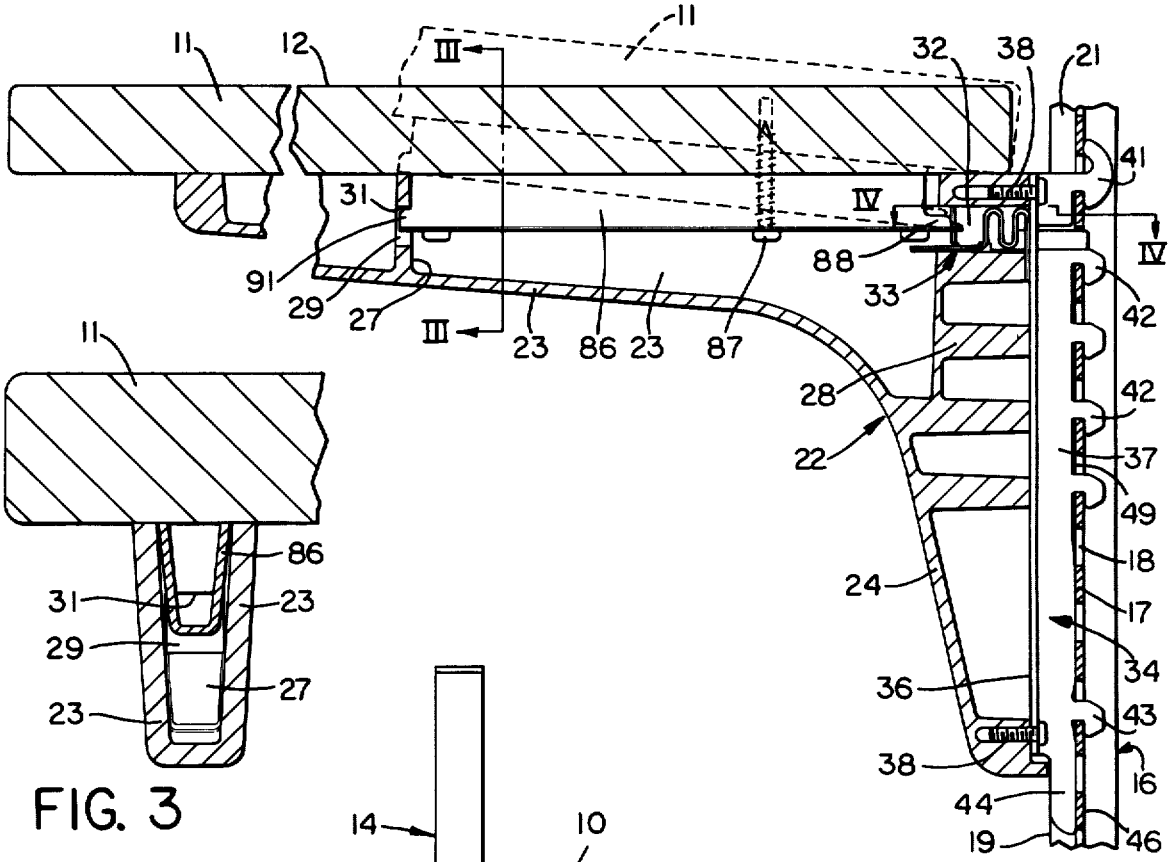
FIG. 2
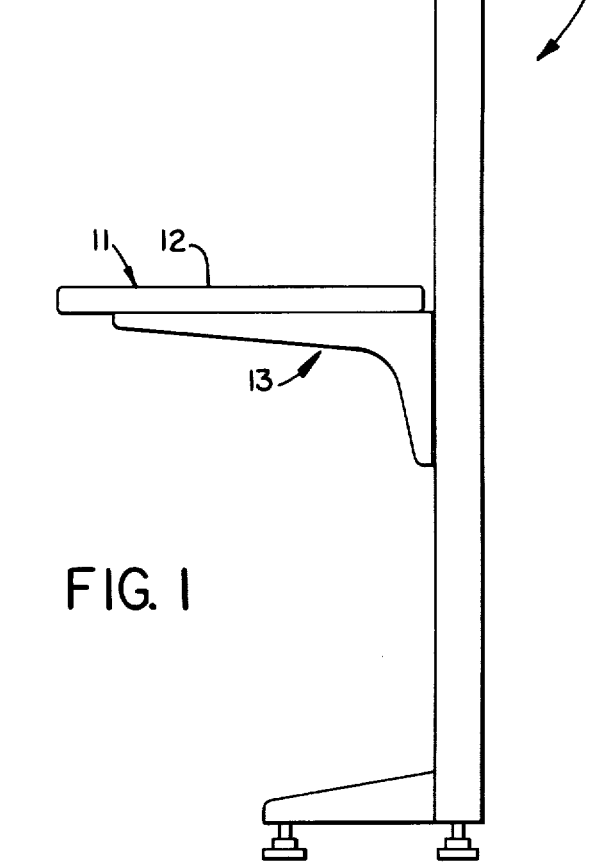
FIG. 3
FIG. 1
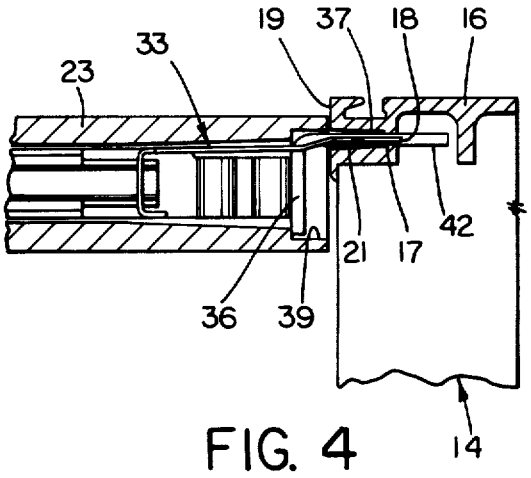
FIG. 4

COMPONENT LOCKING DEVICE

FIELD OF THE INVENTION

This invention relates to a work surface assembly supported on a wall, such as a space divider panel, and in particular to an improved latching support structure for mounting a work surface member on an upright panel.

BACKGROUND OF THE INVENTION

Wall structures formed from a plurality of prefabricated interconnected panels are used extensively in commercial and industrial buildings for dividing interior regions into smaller working spaces. Numerous components are also provided for attachment to these wall panels to totally equip the working space for its intended utilization. These components, such as desks, filing cabinets, book cases and the like, are fixedly mounted on one side of the panel by various types of attaching structures. These attaching structures normally comprise brackets which are secured to the component and define a plurality of vertically spaced, rearwardly projecting, downwardly opening hooks. The panel itself is normally provided with end posts having a row of vertically spaced slots therein, which slots cooperate with the hooks in a conventional manner for fixedly supporting the component on the wall panel.

While a structure of the above-described type has been extensively utilized and is well known, nevertheless this attaching structure possesses recognized disadvantages. The most significant disadvantage of this known structure is that it does not lockingly fix the component to the panel so as to prevent accidental disconnection therebetween. For example, this known structure normally maintains the component on the panel due to the weight of the component causing the hooks to be forced downwardly into engagement with the slotted posts. However, if an upwardly directed force of sufficient magnitude is accidentally applied to the component, then this may cause accidental lifting of the component sufficient to release the hooks from the slotted posts, thereby permitting the component to fall off of the panel. This is obviously damaging to the component and adjacent structures, and also creates a serious hazard to persons in the immediate vicinity. Further, the components are sometimes not properly installed, and thus little external force need be applied to the component to cause it to be accidentally disconnected from the panel.

In view of this problem, numerous attaching structures have been devised to provide a locking or latching relationship between the bracket and the slotted post. These prior attempts, however, have normally involved the use of a movable latch or lock element which is of substantial structural complexity, either with respect to itself or with respect to necessary changes required in either the bracket or the post, so that these structures are less than desirable. Other structures have involved the use of locking or latching members positioned wherein they are readily visible and/or accessible, whereby they not only detract from the appearance of the component and wall system, but they are also easily accidentally released. Such structures are obviously undesirable.

The problem of securely mounting a component on a wall panel is further compounded in those situations where the component comprises a work surface member, such as a desk or table top. The work surface member is normally of substantial size and projects outwardly a substantial distance away from the panel. Due to the large cantilevered projection of the work surface member away from the wall panel, it is normally removably positioned on a pair of underlying L-shaped supports, which supports in turn are provided with hooked brackets which are releasably engaged with the slotted upright posts associated with the panel. It has been observed that these work surface members are particularly prone to being accidentally released from the wall panel since upwardly directed forces often accidentally applied to the outer free edge of the work surface member, such as when a person sitting at the desk stands up and accidentally contacts the free edge of the member. In view of the width of the work surface member, and the resulting leverage provided thereby, this has caused loosening of the supports and release thereof from the wall panel, particularly in those instances where the work surface member is rigidly attached to the supports, as by being screwed thereto.

In many situations, however, the work surface member is not rigidly attached to the underlying supports since this normally requires utilization of a connecting structure which makes mounting of the work surface member difficult and time consuming, which greatly restricts the convenient interchangeability and portability of the work surface member. In this instance, the work surface member is normally connected to the underlying supports by a releasable latch positioned solely adjacent the rear edge of the member. The front edge of the work surface member is not rigidly attached to the supports and hence will readily lift upwardly when an upward force is accidentally applied to the front edge of the member. This not only results in undesirable dropping of the work surface member on the underlying supports, but it can also result in release of the work surface member from the supports.

Accordingly, it is an object of the present invention to provide an improved structure which effectively overcomes the numerous disadvantages mentioned above, and does so utilizing a structure which is economical to manufacture and which permits easy and efficient mounting of a component on a wall panel.

More specifically, it is an object of this invention to provide an improved attachment structure for mounting a furniture component on an upright panel, which attachment structure utilizes a hooked bracket in cooperation with a slotted upright and also provides a latching or locking element which positively retains the hooks in engagement with the slotted upright to prevent accidental disconnection therefrom.

Another object is to provide an improved attachment structure, as aforesaid, which is releasably engageable with both the slotted upright and a work surface member, such as a desk top. This attachment structure specifically includes hook-carrying supports which are releasably attached to the uprights, and which supports in turn have the work surface member releasably attached thereto. This improved structure includes a latching device which automatically engages the slotted upright to fixedly lock the support thereto only when the work surface member is mounted on and properly engaged with the supports. This structure also provides a secure automatic latching of the work surface member to the supports adjacent the outer edge of the member to thereby prevent accidental upward lifting of the work surface member.

Still another object is to provide an improved attachment stucture, as aforesaid, which provides a secure, safe and rigid mounting of the work surface member to the supports, and a positively latched mounting of the supports to the uprights to prevent accidental disconnection of either the work surface member or the supports, while at the same time the work surface member and supports can be readily mounted on or removed from the wall panel without requiring special tools or strenuous effort.

A further object is to provide an improved attachment structure, as aforesaid, wherein the hook-carrying bracket provides an improved snug fitting of the hooks within the slotted upright, but also provides an improved load bearing arrangement between the bracket and the slotted upright so that localized stresses on the hooks and upright are minimized. The improved hook-carrying bracket also utilizes an enlarged top hook which not only provides improved strength and load bearing capability, but also reduces the possible accidental disconnection of the bracket from the upright by permitting such disconnection only when the bracket has the bottom edge thereof swingably moved outwardly a substantial distance away from the upright.

Other objects and purposes of the invention will be apparent to persons familiar with structures of this general type upon reading the following specification and inspecting the accompanying drawings.

BRIEF DESCRIPTION OF THE DRAWINGS

FIG. 1 is a side elevational view illustrating the attachment of a furniture component, more specifically a work surface member such as a desk top, to a wall or space divider panel.

FIG. 2 is an enlarged, fragmentary elevational view taken partially in cross-section and illustrating the attachment of a work surface member to a slotted upright.

FIG. 3 is an enlarged, fragmentary sectional view taken along line III—III in FIG. 2.

FIG. 4 is an enlarged, fragmentary sectional view taken along line IV—IV in FIG. 2.

Figure 5:
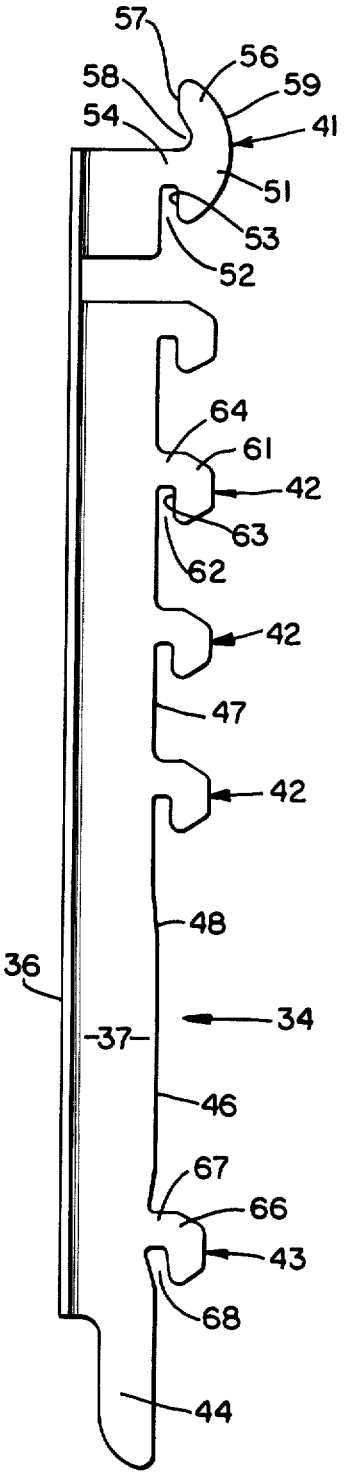
FIG. 5 is an enlarged, side elevational view of the hook-carrying bracket.

Certain terminology will be used in the following description for convenience in reference only and will not be limiting. For example, the words "upwardly", "downwardly", "leftwardly" and "rightwardly" will refer to directions in the drawings to which reference is made. The word "front" will have reference to the outer edge of the work surface member and related components, as appearing on the left side of FIGS. 1 and 2, and the word "rear" will refer to the opposite edge of the work surface member and related components. The words "inner" and "outer" will have reference to directions toward and away from, respectively, the geometric center of the structure and designated parts thereof. Said terminology will include the words specifically mentioned, derivatives thereof and words of similar import.

SUMMARY OF THE INVENTION

The objects and purposes of this invention, including those mentioned above, are provided by a work surface assembly wherein a work surface member, such as a desk top, is mounted on the upper legs of a pair of L-shaped supports. These legs have downwardly projecting vertical legs provided with hook-carrying brackets which are engageable with vertically slotted uprights, such as the end posts of a wall or spaced divider panel. Each support has a spring latch mounted thereon, which spring latch includes a latching bar positioned directly above one of the hooks and adapted to be inserted into the upper part of the slot associated with said one hook to positively prevent upward lifting of the bracket, whereby the support is fixedly locked on the upright. The spring latch is normally maintained in a released position wherein the latch bar is retracted from the slot, even when the support is mounted on the upright, so long as the work surface member is not mounted on the supports. An elongated latch member is fixed to the underside of the work surface member and is positionable within an upwardly directed opening formed in the top leg of the support. The work surface member is mounted on the supports by initially positioning the work surface member adjacent the supports but at a slight angle relative thereto, so that the rear end of the latch member engages the spring latch mounted on the support and causes compression of the spring, which compression also inserts the latch bar into the upper portion of the adjacent slot. After a selected amount of spring compression, the work surface member and its latch member can be swung downwardly into flush engagement with the supports so that the latch member is wholly disposed within the opening. Thereafter the spring partially expands and causes the latch member and work surface member to be moved outwardly a small distance. This causes a projection on the front end of the latch member to hook under a shoulder formed on the support, while at the same time a similar nose on the rearward end of the latch member remains hooked under another shoulder formed on the support. The work surface member is thus positively held against the supports so that the front edge cannot be accidentally lifted away from the supports. When the work surface member is in this locked position, the latching bar is still positioned within the upper portion of the adjacent slot so that the support itself is positively locked to the upright and cannot be accidentally dislodged due to application of an upward force to either the work surface member or the support.

The bracket also incorporates an improved hook structure for association with the slotted upright to provide a more secure engagement with the upright, while at the same time maximizing the strength and load carrying capability of the upright, while minimizing the localized stresses which exist at the bearing points between the hooks and the upright.

DETAILED DESCRIPTION

FIG. 1 illustrates a work surface assembly 10 wherein a work surface member 11, such as a desk or table top having an upper work surface 12, is positioned on a pair of spaced support assemblies 13, which in turn are connected to a conventional upright panel or partition 14, as by being connected to the upright posts associated with the opposite ends of the panel. This basic assembly 10, as illustrated in FIG. 1, is conventional.

The panel or partition 14 is normally provided with uprights or posts adjacent the opposite ends thereof, one such upright 16 being illustrated in FIG. 4. This upright conventionally has a side vertical wall 17 provided with a vertically extending row of spaced slots 18 formed therein, which slots extend through the wall and are vertically elongated, the slots being generally uniformly spaced apart. The slotted wall 17 is, in the illustrated embodiment, spaced rearwardly a substantial distance from the front wall 19 of the upright, such that the upright is provided with an elongated groove or channel 21 extending vertically thereof for providing access to the slots.

The pair of support assemblies 13 which are positioned under the opposite ends of the work surface member 11 are identical except for being mirror images of one another so as to be attachable to the right and left ends of the partition. This support assembly 13 includes an L-shaped support 22 (FIG. 2) which includes horizontal and vertical legs 23 and 24, respectively. The horizontal leg 23 has an opening 26 formed therein and opening upwardly thereof, which opening is defined between an intermediate wall 27 and a rear wall 28. An opening 29 extends through the intermediate wall 27 and defines a shoulder 31 thereabove. A further opening 29 extends through the rear wall 28, and this opening is adapted to have a spring latch 33 positioned therein.

The rigid support 22 has a hook-carrying bracket 34 fixed to the vertical leg thereof, which bracket 34 is vertically elongated and extends throughout the full length of the vertical leg 24. Bracket 34 is of an angled or L-shaped cross section (FIG. 4) and includes mutually perpendicular platelike legs 36 and 37. The leg 36 is positioned within a shallow recess 39 formed in the rear of the vertical support leg 24, with the bracket leg 36 bearing against the rear surface of the support and being fixed thereto, as by a plurality of screws 38.

The other bracket leg 37 projects rearwardly and outwardly of the support 22 and is positionable within the groove 21 of upright 16. This leg 37 has a plurality of hooks fixedly, here integrally, connected thereto and projecting rearwardly thereof. This plurality of hooks includes a rounded top hook 41, a plurality of identical intermediate hooks 42 and a bottom hook 43. These hooks all open downwardly and are adapted for insertion through the slots 18 in the wall 17 for stationarily mounting the support 22 on the upright 16.

The leg 37 of bracket 34 also includes a tongue portion 44 which projects downwardly a substantial distance below the lower hook 43, and also projects downwardly a substantial distance below the lower end of the vertical support leg 24. This tongue portion 44, however, has a width which is no greater than the depth of groove 21 so as to be totally positioned within this groove, as illustrated in FIG. 2.

Bracket leg 37 has, over approximately the lower one-half of its length, a rear edge 46 (FIG. 5) which extends vertically and is adapted to bear against the front side of the slotted wall 17. On the other hand, the upper portion of bracket leg 37 has a straight vertically extending rear edge 47 which is spaced forwardly a small distance, such as approximately 0.03 inches, of the lower rear edge 46. These edges 46 and 47 are joined by a tapered edge portion 48. The forward displacement of edge 47 relative to edge 46 results in a narrow clearance space 49 between edge 47 and slotted wall 17, as illustrated on an enlarged scale in FIG. 2.

The rounded top hook 41 (FIG. 5) includes a rounded substantially half circular part 51, the lower portion of which is separated from the bracket edge 47 by a downwardly opening slot 52. This slot has a width which is slightly greater than the thickness of slotted wall 17 so as to accommodate said wall therein. The slot 52 defines a rear load bearing surface 53 adapted for engagement with the inner surface of the slotted wall 17. A narrow neck portion 54 integrally joins the half-circular part 51 to the bracket leg 37. This half-circular part 51 includes an upper portion 56 which projects upwardly above the neck portion 54 and above the upper end of the legs 36–37. This upper portion 56 has a substantially flat load bearing surface 57 formed on the front side thereof, which surface 57 is substantially coplanar with surface 53. An undercut or recess 58 is provided in the half circular part 51 between the load bearing surface 57 and the neck portion 54. This half circular part 51 has a smooth and rounded rear surface 59. The load bearing surfaces 53 and 57 are vertically spaced apart by a distance approximately equal to the vertical length of the slot 18.

The intermediate hooks 42 are conventional in that each includes a downwardly projecting hook part 61 which is separated from the bracket edge 47 by an intermediate downwardly opening slot 62, which slot defines a rear bearing surface 63 coplanar with the bearing surface 53 associated with the top hook. This hook part 61 is integrally joined with and extends outwardly from the bracket leg by means of an intermediate neck portion 64. The slot 62 is of the same width as the slot 52, thus being slightly wider than the thickness of the slotted wall 17.

Figure 6:
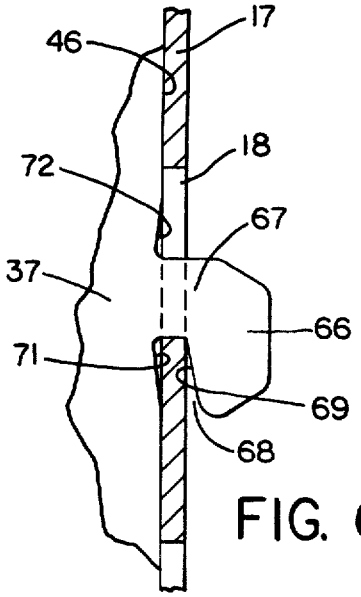
FIG. 6 is an enlarged fragmentary view illustrating the lower hook and its cooperation with the slotted upright.

Considering now the bottom hook 43, as shown in FIG. 6, same again includes a downwardly projecting hook part 66 which is integrally joined to the bracket leg 37 by a narrow neck portion 67. A downwardly opening slot 68 is defined between the hook part 61 and the opposed rear edge 46 of the bracket leg. However, the slot 68 does not open downwardly in a pure vertical direction, as does the slots 52 and 62, but rather the slot 68 is sloped slightly rearwardly as it opens downwardly, such as at an angle of approximately 10° relative to the vertical. The slot 68 thus defines downwardly and rearwardly sloping rear and front, parallel surfaces 69 and 71. The front surface 71 is formed by creating a recess or undercut in the rear edge 46 of the bracket, so that the minimal horizontal width between the rear bearing surface 69 and the vertically extending rear edge 46 is thus substantially equal to the thickness of the slotted wall 17. This insures that the slotted wall 17 will be tightly wedged within the slot 68 so as to snugly bear against the rear wall 46. A further undercut or recess 72 is provided in the rear edge 46 directly above the bottom hook 43 to facilitate the formation of an appropriate radius or rounded corner between the bracket leg and the neck portion of the hook.

Figure 8:
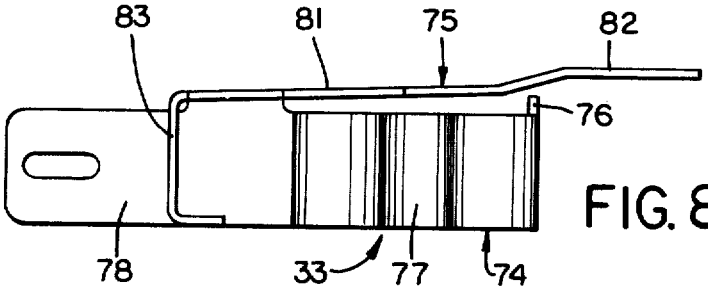
FIG. 8 is a top view of the spring latch illustrated in FIG. 7.
Figure 7:
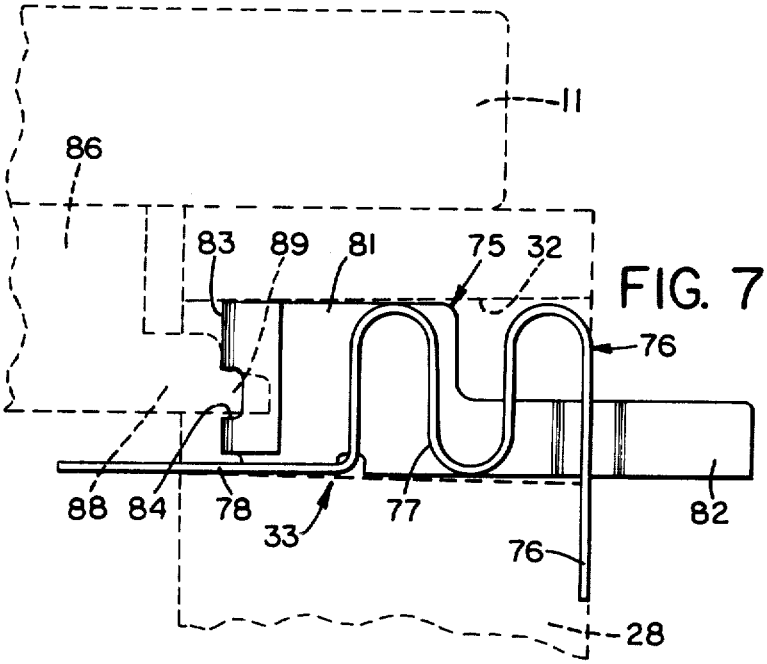
FIG. 7 is an enlarged, side elevational view of the spring latch.

Considering now the spring latch 33, same is comprised of spring and latching portions 74 and 75, respectively, as shown in FIGS. 7 and 8. The spring portion 74 includes a vertical support plate 76 which is fixedly secured to the support 22, as by being fixedly held between the bracket leg 36 and the rear wall of the vertical support leg 24, as indicated in FIG. 2. This support plate 76 is in turn connected to a wave spring 77 which is of a sinusodial configuration, which wave spring in turn terminates in a horizontal guide plate 78 which is slidably disposed within the opening 32 formed in support 22.

The latching portion 75 includes a vertical connecting plate 81 which is fixed to one edge of the guide plate 78 and projects upwardly therefrom. This connecting plate 81 terminates in an elongated latching bar or finger 82 which projects rearwardly of the support 22 so as to extend into groove 21 formed in the upright 16. The bracket leg 37 has a cut-out 85 through which the finger 82 projects. Latching finger 82 is formed as a thin plate-like element and has a height suitable to enable it to be inserted into and substantially fill the open upper portion of the slot 18 after the hook 42 has been engaged with the slotted wall 17. For this purpose, the latching finger 82 is positioned directly above the uppermost intermediate hook 42 and cooperates with the respective slot, as shown in FIG. 2.

The connecting plate 81 also connects to an actuator plate 83 which is disposed vertically and extends across the guide plate 78 in substantially perpendicular relationship to both the guide plate 78 and the connecting plate 81. The actuator plate 83 has a slotlike opening 84 formed therethrough and extending thereacross.

As illustrated, the spring latch 33 is preferably in integral one-piece member, being formed from thin spring steel plate. However, it will be appreciated that spring latch 33 could be formed from two or more elements, and utilizing a different type of spring, without departing from the desirable structural and functional features of this invention.

When the spring latch 33 is positioned within the opening 32 of the support 22, and when this support 22 is mounted on the upright 16, the spring latch 33 is normally maintained in a relaxed position wherein the spring 77 is fully expanded so that the guide plate 78 is thus urged forwardly (leftwardly in FIG. 2) a maximum extent. In this relaxed position, the latching finger 82 extends into the groove 21 but does not project rearwardly far enough to either contact the slotted wall 17 or project through the slot 18.

The spring latch 33 is actuated to lockingly engage the upright 16 only when the work surface member 11 is properly mounted on the supports 22. For this purpose, the work surface member 11 has an elongated latch member 86 (FIGS. 2 and 3) secured to the underside thereon, as by screws 87, one of said latch members 86 being provided for association with each support 22. This latch member 86 is formed as an elongated channel which extends perpendicularly of the work surface member between the front and rear edges thereof. The latch member 86 is adapted to be positioned within the upwardly directed opening 26 formed in the support 22 and has a length which is only slightly less than the length of this opening. A double-stepped nose portion 88 projects outwardly from the rearward end of the latch member 86, and the outer step 89 (FIG. 7) which has an upper surface tapered at an angle of approximately 10 degrees is sized so as to project through the opening 84 in the latch spring 33. A further projecting nose 91 (FIG. 2) is formed on the front end of the latch member 86, which nose 91 is adapted to be inserted into the opening 29 associated with the intermediate wall 27.

OPERATION

Assuming that a work surface assembly 10 is initially disassembled, then the first step is to mount the supports 22 on the uprights 16. This is accomplished by first positioning each upright 22 adjacent its respective support 16 so that the hooks are disposed substantially in alignment with the groove 21. The support 22 is then tilted upwardly (clockwise in FIG. 2) substantially about the top hook 41 until the normally horizontal support leg 23 is projecting upwardly. When in this position, the upper portion 56 of top hook 41 can be inserted into the appropriate slot 18, followed by downward swinging of the support (counterclockwise in FIG. 2) until the remainder of the top hook 41 together with the intermediate hooks 42 and bottom hook 43 pass through their respective slots 18 so as to be positioned behind the slotted wall 17. When so positioned, the support 22 is then pushed downwardly so that the portions of the wall 17 as located directly below the slots 18 enter into the hook slots 52, 62 and 68. In view of the rearwardly sloped configuration of lower slot 68, the slotted wall 17 is tightly wedged between the rear hook part 66 and the rear bracket edge 46. The remaining hooks, namely the top hook 41 and intermediate hooks 42, will solely have a bearing engagement with the rear side of the slotted wall 17. The top hook 41, however, engages the rear side of slotted wall 17 both above and below its respective slot 18 due to the two bearing surfaces 57 and 53. Since any loads imposed on support 22 create a counterclockwise moment thereon, as appearing in FIG. 2, the top hook 41 and intermediate hooks 42 resist this moment due to their engagement with the rear side of the slotted wall 17. The lower hook 43, due to its wedging engagement with both sides of the slotted wall 17, provides increased rigidity between the bracket and the upright which increases the resistance against the counterclockwise moment imposed on the support by the external load. In addition, since tongue 44 projects downwardly beyond the lower edge of the vertical support leg 24, the lowermost corner of this tongue 44 where it engages the slotted wall 17 tends to act as a fulcrum or pivot point for the support relative to the upright, and the increased length and bearing area provided by this tongue provides still further strength and rigidity to the overall assembly, and maximizes the lever arms from the fulcrum to the individual hooks to thereby minimize the contact and bearing stresses which exist between the hooks and the slotted wall.

With the support 22 mounted on the upright 16 as above described, but prior to the mounting of the work surface member 11 thereon, the spring latch 33 is maintained in a normal or nonstressed condition such that the latching finger 82 projects into the groove 21 but does not engage the slotted wall 17 nor project through the slot 18. Thus, while the hooks fixedly maintain the support 22 on the upright 16, nevertheless the latch spring 33 remains in a released condition and hence does not positively lock the support 22 to the upright 16.

The work surface member 11 is now mounted on the uprights, this being accomplished by initially positioning the work surface member 11 adjacent the horizontal support legs 23 but at a slight angle relative thereto, as indicated in dotted lines in FIG. 2. By positioning the member 11 at this slight angle but with the rear edge resting on the support legs 23, this causes the rearward end of the latching channel 86 to project downwardly into the opening 26. By pushing the work surface member 11 rearwardly toward the upright, while maintaining the member 11 at the slight angle, this causes the lower step 89 of the double-stepped nose 88 to enter into the opening 84, whereas the second step of this nose 88 bears against the actuator plate 83. Continued rearward pushing of the work surface member 11 thus causes the spring 77 to be compressed, and the latching finger 82 to be moved rearwardly and inserted through the open upper portion of the slot 18 so as to be positioned directly above the upper most intermediate hook 42. This permissable compression of the spring 77 and the corresponding rearward movement of the latching finger 82 can obviously occur only if the hooks are properly seated within the slots as to permit the latching finger to pass through the upper portion of the respective slot. If the hooks are not properly seated, then the latching finger will not move, and hence it will not be possible to mount the work surface member. This will then indicate to the installer that the support 22 is not properly mounted on the upright.

Assuming that the latching finger 82 does properly pass through the upper portion of the slot 18, then after the work surface member 11 has been moved rearwardly to a position closely adjacent the upright, then the front edge of the work surface member 11 is pivoted downwardly so that the complete latching channel 86 is disposed within the opening 26 and the work surface member 11 rests on the upper surface of the horizontal support legs 23. The compressed spring 77 then tends to partially expand and urges the work surface member 11 forwardly (leftwardly in FIG. 2) until the channel 86 abuts against the intermediate partition 27, whereupon the nose 91 projects into the opening 29 and hence is disposed below the shoulder 31. The projecting noses 88 and 91 as located on opposite ends of the latching channel 86 are now located below appropriate shoulders disposed on the support 22 so that the work surface member 11 is positively held down against the support 22 along both the front and rear edges thereof, and cannot be lifted upwardly, even upon the application of an external upwardly or downwardly directed force to the front edge thereof.

During the partial expansion of the spring 77 so as to lock the work surface member 11 to the support, as above described, the latching finger 82 is partially retracted (that is moved leftwardly) relative to the upright. However, this retraction is not enough to withdraw the finger 82 from the slot 18, so that the finger still positively locks the support 22 to the upright 16. Accordingly, the work surface member 11 is positively locked downwardly against the supports 22, and this locking arrangement in turn positively locks the supports 22 to the uprights 16 so that any upwardly directed force imposed against the system will be unable to cause an accidental release of either the work surface member or the supports.

When a disassembly of the work surface system is desired, this is accomplished by pushing the work surface member 11 rearwardly toward the wall (rightwardly in FIG. 2) to cause compression of spring 77 and removal of nose 91 from the opening 29, whereupon the front edge member 11 is tilted upwardly and the complete member 11 can be removed from the supports 22. This in turn enables the spring 77 to expand to its normal relaxed position which causes a full retraction of the latching finger 82 from the slot 18, so that the supports 22 are no longer locked to the uprights. The supports 22 can then be moved upwardly until the hooks 42 and 43 can be passed through the slots 18. However, the support 22 cannot be pulled directly outwardly, but must be pivoted upwardly (clockwise in FIG. 2) about the top hook 41 so as to remove the hooks 42 and 43, which upward pivoting occurs until the normally horizontal suport leg 23 is substantially upright, whereupon the top hook 41 can then be completely removed from its slot to thereby totally disconnect the support 22 from the upright.

While the relationship between the hook-carrying bracket 34 and the upright 16 is highly desirable for use in the work surface assembly of the present invention, nevertheless it will be appreciated that this desirable relationship will also be advantageous for use in supporting numerous other devices or components on slotted uprights.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, an upright wall structure defining a pair of horizontally spaced uprights each having a wall with a vertically extending row of elongated slots therein, a pair of substantially L-shaped supports adapted for releasable securement to said uprights, each of said supports including rearwardly and downwardly projecting hook means positioned for engagement with the slotted wall of the respective upright, and a shelflike article positioned on and releasably attached to said supports, whereby said article is positioned adjacent and projects horizontally outwardly from said wall structure in cantilevered relationship thereto, the improvement comprising latch means mounted on said support and cooperating with said slotted upright for positively locking said support to said upright, said latch means including a latch member movably supported on said support and movable relative thereto into a latching position wherein it projects into one of the slots of said upright for preventing upward displacement of said support relative to said upright, said latch means also including spring means urging said latch member into a released position out of engagement with said upright even when said support is mounted on said upright, and actuating means mounted on said article and disposed for engagement with said latch means to move the latch member into said latching position when said article is attached to said supports.

2. A combination according to claim 1, including releasable hold-down means coacting between said supports and said article for preventing upward movement of said article away from said supports without first releasing said hold-down means, and said spring means urging said hold-down means into a holding position wherein upward movement of the article away from the supports is prevented.

3. In combination, an upright wall structure defining a pair of horizontally spaced uprights each having a wall with a vertically extending row of elongated slots therein, a pair of substantially L-shaped supports adapted for releasable securement to said uprights, each of said supports including rearwardly and downwardly projecting hook means positioned for engagement with the slotted wall of the respective upright, and a shelflike article positioned on and releasably attached to said supports, whereby said article is positioned adjacent and projects horizontally outwardly from said wall structure in cantilevered relationship thereto, the improvement comprising latch means mounted on said support and cooperating with said slotted upright for positively locking said support to said upright, said latch means including a latch member movable into a latching position wherein it projects into one of the slots of said upright for preventing upward displacement of said support relative to said upright, said movable latch member being normally maintained in a released position out of engagement with said upright even when said support is mounted on said upright, actuating means mounted on said article and disposed for engagement with said latch means to move the latch member into said latching position when said article is attached to said supports, and releasable hold-down means coacting between said supports and said article for preventing upward movement of said article away from said supports without first releasing said hold-down means, said hold-down means including a first hold-down part fixed to said article and projecting downwardly therefrom adjacent the rear edge thereof, said first hold-down part comprising said actuating means and being positioned for direct engagement with said latching means, said hold-down means including a second hold-down part fixed to said article and projecting downwardly therefrom, said second hold-down part being spaced from said first hold-down part so as to be positioned more closely adjacent the front edge of said article, said second hold-down part being engageable with said support for preventing upward movement of the front edge of said article away from said supports.

4. A combination according to claim 3, wherein said latch means includes spring means coacting with said latch member for normally urging said latch member away from said latching position toward said released position, and said first hold-down part engaging said latch means and causing compression of said spring means to thereby hold said latch member in said latching position when said article is fixedly positioned on and engaged with said supports.

5. The combination according to claim 4, wherein said spring means urges said article outwardly away from said structure and moves said article relative to said supports for causing said second hold-down part to engage said support to prevent upward movement of the front edge of said article, said latch member being engaged with said slotted wall when said article is in this latter-mentioned position.

6. A combination according to claim 5, wherein said shelflike article comprises a substantially flat horizontal platelike member which is positioned adjacent said wall structure and extends between and is supported on said pair of uprights, said platelike member having a pair of elongated hold-down elements fixed to the underside thereof and projecting horizontally in substantially perpendicular relationship to said wall structure, said support having an upper horizontal leg portion which projects perpendicularly outwardly from said wall structure, said horizontal leg portion defining therein an upwardly directed opening which is elongated in the longitudinal direction of the leg portion, said opening being bounded at opposite ends by shoulders, said hold-down element being positionable within said opening and having projections at opposite ends thereof which define said first and second hold-down parts and are positioned under said shoulders for preventing upward movement of said platelike member relative to said supports, the projection at the rearward end of said hold-down element being engageable with said latch means.

7. In combination, a pair of horizontally spaced uprights each provided with a vertical wall containing therein a vertically extending row of elongated slots, a pair of rigid supports releasably connected to said uprights, each said support including a vertically elongated portion positioned directly adjacent said upright and having a hook-carrying bracket positioned in fixed but releasable engagement with the slotted wall of said upright, each said support also including a horizontally elongated portion which is fixed to the vertical portion and projects horizontally outwardly from said upright in substantially cantilevered relationship therewith, said horizontal portion defining an upper substantially horizontal support surface, and an article extending between said supports and positioned in engagement with said upper support surfaces for holding said article adjacent one side of said uprights, the improvement comprising:

releasable latch means coacting between said support and said slotted upright for positively preventing disconnection of said support from said upright, said latch means including a movable latch member engageable with one of the slots of said upright; and releasable hold-down means coacting between said article and said support for fixedly but releasably holding said article against said supports to positively prevent upward movement of said article away from said supports, said hold-down means being engageable with said latch means to prevent release of said latch means from said support whenever said article is fixedly mounted on said supports.

8. A combination according to claim 7, wherein said latch means and said hold-down means cooperate to permit said article to be fixedly mounted on said supports only when said latch member is in latching engagement with said upright.

9. In combination, a pair of horizontally spaced uprights each provided with a vertical wall containing therein a vertically extending row of elongated slots, a pair of rigid supports releasably connected to said uprights, each said support including a vertically elongated portion positioned directly adjacent said upright and having a hook-carrying bracket positioned in fixed but releasable engagement with the slotted wall of said upright, each said support also including a horizontally elongated portion which is fixed to the vertical portion and projects horizontally outwardly from said upright in substantially cantilevered relationship therewith, said horizontal portion defining an upper substantially horizontal support surface, and an article extending between said supports and positioned in engagement with said upper support surfaces for holding said article adjacent one side of said uprights, the improvement comprising:

releasable latch means coacting between said support and said upright for positively preventing disconnection of said support from said upright when said latch means is in a latched position, said latch means incuding a latch member movable substantially transversely with respect to said upright between said latched position wherein said latch member projects through one of said slots and a released position wherein said latch member is withdrawn from said slot, said latch member being movable in one direction from said released position into said latched position:

first latching means coacting between said article and said support adjacent the rearward edge of said article for preventing the rearward edge of said article from being moved upwardly relative to said support;

second latching means coacting between said article and said support at a location spaced outwardly from said uprights a substantial distance from said first latching means for holding said article against said support to prevent the front edge of said article from being moved upwardly away from said support;

said first and second latching means respectively including first and second latching member fixed to said article and being releasably engageable with said support, said second latching member being fixed to said article at a location spaced a substantial distance from the rear edge thereof, and said first latching member being fixed to said article at a location positioned in close proximity to said rear edge;

said article and said support having cooperating means permitting said article to be slidably supported on said support for slidable linear displacement of said article in a horizontal direction substantially perpendicular to said upright between a first position wherein the rear edge of the article is closely adjacent said uprights and a second position wherein the rear edge of said article is spaced outwardly a greater distance from said uprights, said first and second latching members both being engaged with said support when said article is in said second position for positively preventing upward displacement of said article, said second latching member being released from said support when said article is in said first position, and said first latching member being engaged with said latch means in both of said first and second positions and causing said latch member to be inserted a further distance through said slot when said article is moved from said second position toward said first position; and spring means coacting with said latch member and tending to resiliently urge same in the opposite direction when said latch member is in the fully inserted position for resiliently slidably urging said latch member outwardly to thereby push said first latching member and said article into said second position.

10. The combination of an upright and a load-supporting article releasably and stationarily mounted on said upright in cantilevered relationship thereto, said upright having a vertically extending row of elongated slot-like openings formed in a wall thereof, and said article having a bracket fixed thereto and defining a plurality of rearwardly projecting and downwardly opening hooks adapted for insertion through a plurality of said slot-like openings and being movable downwardly relative to said wall so that said hooks engage said wall and stationarily connect said article to said upright, comprising the improvement wherein:

said bracket is vertically elongated and has a vertically elongated rear wall, said rear wall including upper and lower portions which are each of substantial vertical extent and are defined by substantially vertical planar surfaces which extend in substantially parallel relationship, the vertical planar surface defining the lower portion of said rear wall being offset rearwardly a slight distance from the vertical planar surface defining the upper portion of said rear wall;

said plurality of hooks including at least one hook fixed to the upper portion of the rear wall and projecting rearwardly thereon, said one hook being of a generally L-shaped configuration and cooperating with said rear wall so as to define a downwardly opening slot defined between a pair of approximately parallel and substantially vertical walls, the width of said slot as measured perpendicularly between said vertical walls being slightly greater than the thickness of said slotted wall;

said plurality of hooks including at least a second hook fixed to and projecting rearwardly from the lower portion of said rear wall, said second hook also being of a substantially L-shaped configuration and cooperating with said rear wall to define a downwardly opening slot, said slot being defined between approximately parallel opposed walls defined on said hook and said rear wall, said opposed walls extending downwardly and being sloped rearwardly at a small angle relative to the vertical for causing said slotted wall when received within said slot to be wedgingly and snugly engaged with both of said opposed walls so that the front side of said second hook engages the rear of said slotted wall simultaneous with the snug engagement between the lower portion of said rear wall and the outer surface of said slotted wall;

said one hook having the front surface thereon engaged with the rear surface of said slotted wall when a downwardly directed load is imposed on said bracket, whereby a small clearance space exists between the front surface of said slotted wall and the upper portion of the rear wall of said bracket.

11. The combination according to claim 10, wherein said plurality of hooks includes a top hook fixed to the rear wall of said bracket adjacent the upper end thereof and projecting rearwardly therefrom, said top hook being of a substantially T-shaped configuration and including a substantially half circular head portion positioned rearwardly of said slotted wall, said head portion including upper and lower bearing surfaces disposed on the front side thereof and spaced apart so as to engage the rear surface of said slotted wall at locations disposed directly above and below the slotlike opening through which the top hook projects.

12. A combination according to claim 1, including releasable hold-down means coacting between said supports and said article for preventing upward movement of at least one of the front and rear edges of said article away from said supports without first releasing said hold-down means, said hold-down means including a first hold-down part fixed to and projecting downwardly from said article and engageable with a second hold-down part fixed to said supports, said spring means causing said first hold-down part to engage said second hold-down part when the article is engaged with and supported on said supports.

* * * * *